US005318821A

United States Patent [19]

Bradley, Jr.

[11] Patent Number: 5,318,821

[45] Date of Patent: * Jun. 7, 1994

[54] CONTAINER COVER

[76] Inventor: James B. Bradley, Jr., 4805 Inverness Dr., Tyler, Tex. 75703

[ * ] Notice: The portion of the term of this patent subsequent to Apr. 1, 2010 has been disclaimed.

[21] Appl. No.: 41,823

[22] Filed: Apr. 1, 1993

[51] Int. Cl.[5] ..... B65D 65/10

[52] U.S. Cl. ..... 428/100; 47/72; 150/154; 150/901; 220/404; 220/460; 220/470; 220/732; 220/737; 220/739; 428/34.2; 428/35.2; 428/36.91; 428/36.92

[58] Field of Search ..... 428/100, 34.2, 35.2, 428/36.91, 36.92; 47/72; 150/154, 901; 220/737, 739, 732, 470, 404, 460

[56] References Cited

U.S. PATENT DOCUMENTS

| | | | |
|---|---|---|---|
| 716,668 | 12/1902 | Cheney | 301/43 |
| 1,421,628 | 7/1922 | Watkins | 47/72 |
| 1,446,563 | 2/1923 | Hughes | 47/72 |
| 1,520,647 | 12/1924 | Hennegan | 47/72 |
| 1,610,652 | 12/1926 | Bouchard | 47/72 |
| 1,697,751 | 1/1929 | Blake | 47/72 |
| 2,152,648 | 4/1939 | Jones | 47/72 |
| 2,209,778 | 7/1940 | Krasowski | 47/72 |
| 2,302,259 | 11/1942 | Rothafuss | 47/72 |
| 2,606,106 | 8/1952 | Albertson | 47/72 |
| 4,216,620 | 8/1980 | Weder et al. | 47/72 |
| 4,558,801 | 12/1985 | Vilutis | 220/470 |
| 5,109,588 | 5/1992 | Hewlett | 220/903 |
| 5,195,271 | 3/1993 | Bradley | 47/72 |

*Primary Examiner*—Ellis P. Robinson
*Assistant Examiner*—Nasser Ahmad
*Attorney, Agent, or Firm*—Howison, Clapp & Korn Ross

[57] ABSTRACT

A container cover includes a flexible covering disposed adjacent to the exterior side wall of a container for completely covering the exterior side wall. A fastener is provided for detachably interconnecting the edges of the flexible covering to the container. The fastener is disposed adjacent to the top and bottom edges fastener is provided adjacent the ends of the flexible covering for selectively interconnecting the ends such that the flexible covering encircles the container.

4 Claims, 2 Drawing Sheets

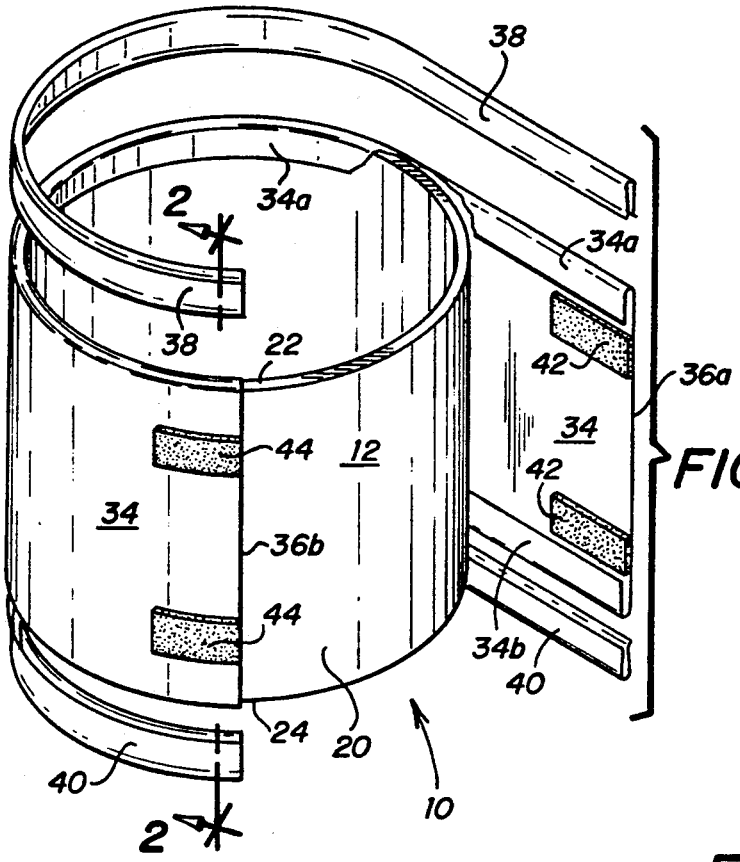
FIG. 1
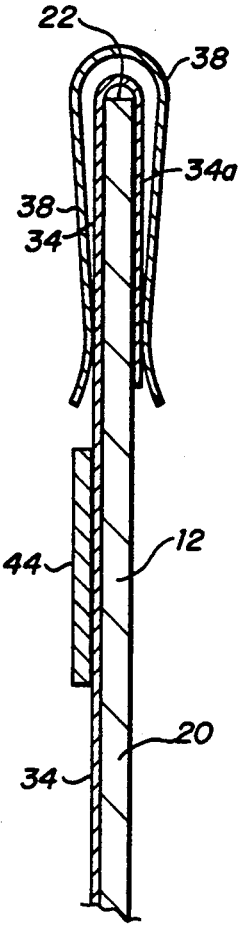
FIG. 2
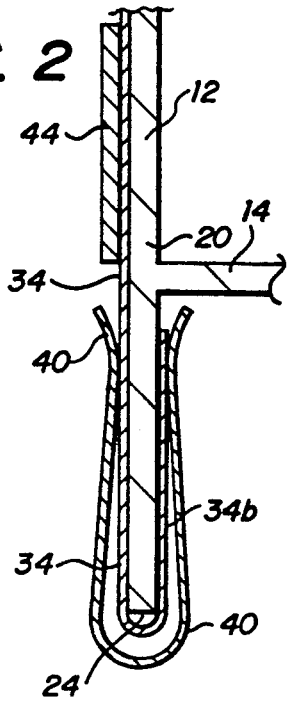

CONTAINER COVER

TECHNICAL FIELD OF THE INVENTION

This invention relates to containers, and more particularly to a decorative cover for containers, such as, for example, a waste basket.

BACKGROUND OF THE INVENTION

It is desirable that waste baskets or other containers have a unique color or texture appearance to match with the decor and color scheme of the room in which the container is located. Present waste baskets are fabricated from plastic in various colors and shapes, may be woven or covered with elastic fabric. Elasticized covers are produced in standard print fabrics that seldom meet the coordinating needs of the user.

A need thus exists for a container cover to provide a simple and aesthetically acceptable decor coordinating unit to cover containers, such as waste baskets, with fabric, wallpaper, foil or other material.

SUMMARY OF THE INVENTION

In accordance with the present invention, a container cover in the form of a flexible covering is provided for the container and is disposed adjacent to the exterior side wall of the container for completely covering the exterior side wall. A fastener is provided for detachably interconnecting the edges of the flexible covering to the container. The fastener is disposed adjacent to the top and bottom edges of the covering and the container. Additionally, a fastener is provided adjacent the ends of the flexible covering selectively interconnecting the ends, such that the flexible covering encircles the container.

BRIEF DESCRIPTION OF THE DRAWINGS

For a more complete understanding of the present invention and for further advantages thereof, reference is now made to the following Description of the Preferred Embodiments taken in conjunction with the accompanying Drawings in which:

FIG. 1 is an exploded perspective view of the present container cover;

FIG. 2 is an assembled sectional view taken generally along sectional lines 2—2 of FIG. 1.

DESCRIPTION OF THE PREFERRED EMBODIMENTS

Figure 3:
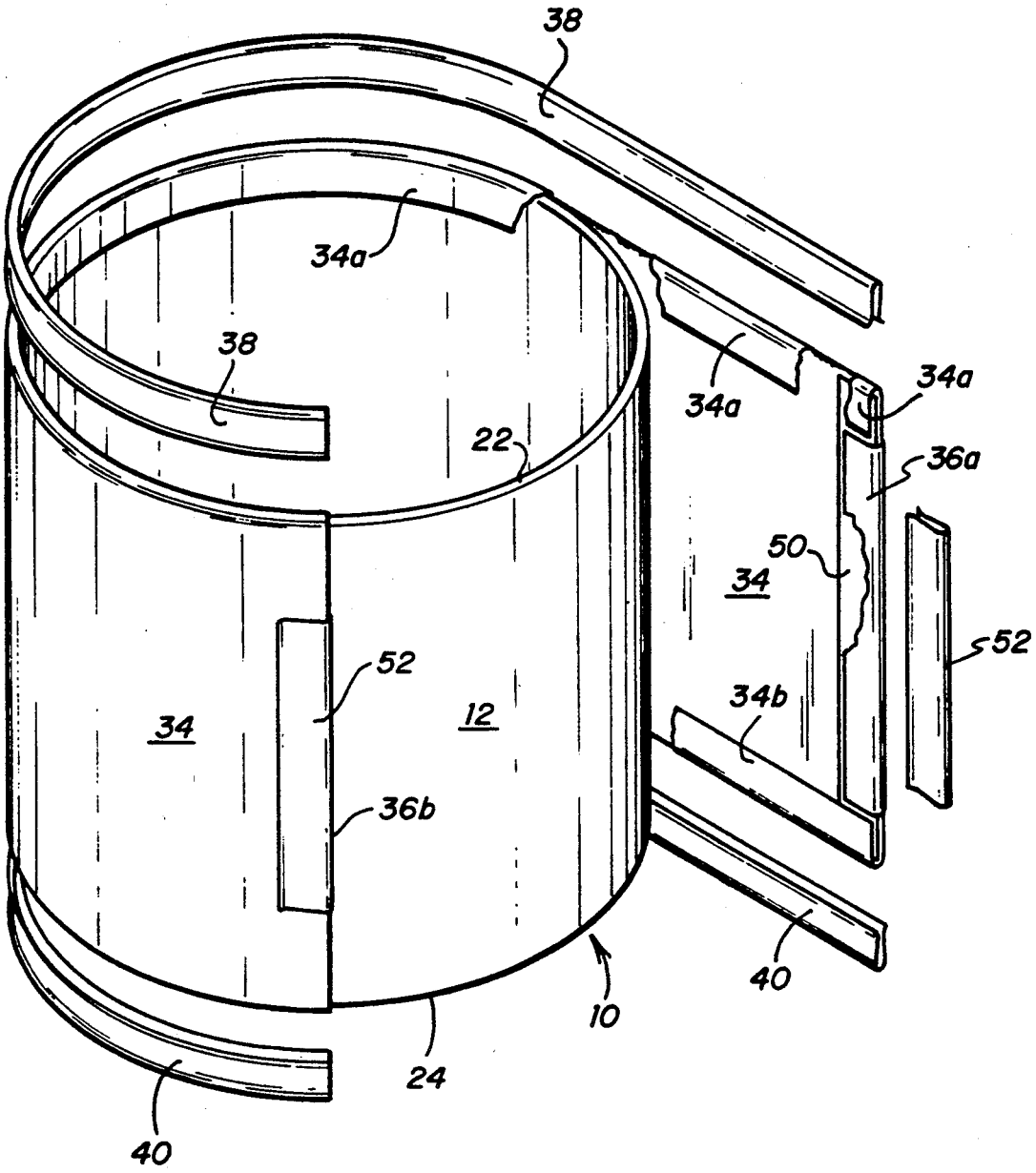
FIG. 3 is an exploded perspective view of an additional embodiment of the present container cover.

Referring simultaneously to FIGS. 1 and 2, the present container cover is illustrated, and is generally identified by the numeral 10. Container cover 10 is utilized for covering a container 12, such as for example, a waste basket, having a recessed bottom 14, side wall 20, and top and bottom edges 22 and 24, respectively. Container cover 10 circumferentially surrounds container 12 when in use.

An important aspect of the present invention is the use of a covering 34 for selectively covering container 12. Covering 34 includes ends 36*a* and 36*b* and is disposed adjacent to side wall 20 of container 12, and may comprise, for example, fabric, wallpaper or other desired decorative material selected in accordance with the decor of the room in which container 12 is located. Portions 34*a* and 34*b* of covering 34 extend over the top and bottom edges, 22 and 24, respectively, of container 12 and lie adjacent to side wall 20 of container 12.

Covering 34 is detachably interconnected to container 12 utilizing top and bottom clips, 38 and 40, respectively. Clips 38 and 40 extend completely along the length of top and bottom edges 22 and 24, and function to easily attach covering 34 to container 12. No adhesive or permanent securing device is required to attach covering 34 to container 12 to allow for the easy removal and reattachment of a new covering 34 depending upon the decor desired. Both the entire top and bottom of covering 34 are completely attached to container 12 to thereby provide a positive attachment of covering 34 to container 12, as well as providing a neat and clean appearance for container 12.

Ends 36*a* and 36*b* of covering 34 are selectively interconnected to permit covering 34 to circumferentially surround container 12 when installed. The interior of covering 34 includes strips 42 of Velcro fastener material. Strips 42 may be adhesively secured to covering 34 adjacent end 36*a*. Disposed adjacent to end 36*b* of covering 34 are mating Velcro strips 44 which are adhesively secured to the outside of covering 34 for mating with strips 42. Velcro strips 42 and 44 thereby permit ends 36*a* and 36*b* to be selectively joined and secured together so that covering 34 encircles container 12.

Alternatively, Velcro strips 44 may be adhesively secured to side wall 20 of container 12. Disposed adjacent to ends 36*a* and 36*b* on the interior side of covering 34 are adhesively secured Velcro strips 42 which permit ends 36*a* and 36*b* to be selectively joined to the Velcro strips 44 on side wall 20 of container 12 so that covering 34 encircles container 12 and is directly attached to container 12.

Various other types of fasteners may be used for securing ends 36*a* and 36*b* of covering 34, to each other or to container 12 such as, for example, snaps, clips and other types of mechanical fastening devices.

Referring to FIG. 3, an alternative embodiment of the present invention for securing cover 34 to container 12 is illustrated. Ends 36*a* and 36*b* are folded to the interior over and around vertical strips 50. Vertical strips 50 comprise thin, flat, rigid strips, and may be fabricated from plastic, and extend approximately the entire height of container 12. Covering 34 may be held to strips 50 utilizing clips 52. The configuration illustrated in FIG. 3 of the present invention ensures a neat and clean joining of ends 36*a* and 36*b* of covering 36. Strips 50 are held by clips 38 and 40, and thereby maintain covering 34 attached to container 12.

It therefore can be seen that the present container cover provides for a simple and aesthetically pleasing decor coordinating unit that will permit the selective attachment of various coverings for enclosing containers.

Whereas the present invention has been described with respect to specific embodiments thereof, it will be understood that various changes and modifications will be suggested to one skilled in the art and it is intended to encompass such changes and modifications as fall within the scope of the appended claims.

I claim:

1. A container decorative cover adapted to cover a container having a side wall having an outer and inner surface, and top and bottom edges, said decorative cover comprising:

a flexible covering adapted to contact and conform to the outer surface of the side wall of a container for completely covering the outer surface of the side wall and extending over the top and bottom edges of a container, said flexible covering having interior and exterior side walls, parallel top and bottom edges, and first and second ends;

top and bottom removeable resilient clips for detachably interconnecting said flexible covering to a container, said top and bottom removeable resilient clips adapted to engage the top and bottom edges, respectively, of a container along the entire top and bottom edges, respectively, of a container and for engaging said top and bottom edges of said flexible covering on said exterior side wall of said flexible covering; and fastener means attached to said flexible covering and disposed along said ends of said flexible covering for selectively and non-permanently interconnecting said ends.

2. The container decorative cover of claim 1 wherein said fastener means includes means disposed on said interior side wall of said flexible covering along said first end thereof and means disposed on said exterior side wall of said flexible covering along said second end thereof for non-permanently mating with said means disposed on said interior side wall.

3. The container decorative cover of claim 1 wherein said fastener means includes Velcro material.

4. The container decorative cover of claim 1 and further including:

means extending along said first and second ends of said flexible covering for engaging said top and bottom removeable resilient clips.

* * * * *

UNITED STATES PATENT AND TRADEMARK OFFICE

CERTIFICATE OF CORRECTION

PATENT NO. : 5,318,821

DATED : JUNE 7, 1994

INVENTOR(S) : JAMES B. BRADLEY, JR.

It is certified that error appears in the above-identified patent and that said Letters Patent is hereby corrected as shown below:

Title page, item [57] Abstract:

LINE 6, following "edges" insert -- of the covering and the container. Additionally, a --

Signed and Sealed this

Twenty-second Day of November, 1994

*Attest:*

*Attesting Officer*

BRUCE LEHMAN

*Commissioner of Patents and Trademarks*